US007255101B2

(12) United States Patent
Grützke et al.

(10) Patent No.: US 7,255,101 B2
(45) Date of Patent: Aug. 14, 2007

(54) APPARATUS WITH A DOOR, IN PARTICULAR, A COOKING APPLIANCE DOOR

(75) Inventors: Joachim Grützke, New Bern, NC (US); Thomas Rembold, Obersulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/627,856

(22) Filed: Jul. 25, 2003

(65) Prior Publication Data

US 2004/0144380 A1 Jul. 29, 2004

Related U.S. Application Data

(63) Continuation of application No. PCT/EP02/00647, filed on Jan. 23, 2002.

(30) Foreign Application Priority Data

Jan. 25, 2001 (DE) ..... 101 03 303

(51) Int. Cl.
*F24C 15/02* (2006.01)
*F24C 15/04* (2006.01)

(52) U.S. Cl. ..... 126/194; 126/190; 49/258; 312/109; 312/138.1; 312/139.1

(58) Field of Classification Search ..... 126/290, 126/291, 294, 214 R, 37 R, 37 A; 312/322, 312/323, 307, 109, 107; 49/258, 260; 16/362
See application file for complete search history.

(56) References Cited

U.S. PATENT DOCUMENTS 479,857 A * 8/1892 Tettelbach ..... 126/190
523,690 A * 7/1894 Sinclair ..... 49/257
646,200 A * 3/1900 Allen ..... 312/109
840,061 A * 1/1907 Hofman ..... 211/94.01
1,379,091 A * 5/1921 Farquhar ..... 312/274
1,543,510 A * 6/1925 Nicolaus ..... 126/190
1,698,509 A * 1/1929 Probert ..... 312/291
1,855,759 A * 4/1932 Hofferbert ..... 126/190
1,940,259 A * 12/1933 Lindemann et al. .... 126/214 R
1,944,626 A * 1/1934 Allbert ..... 126/67
2,163,258 A * 6/1939 Lautz ..... 126/214 R
2,241,884 A * 5/1941 Noble ..... 312/323
2,254,832 A * 9/1941 Weight ..... 312/233
2,483,562 A * 10/1949 Reeves ..... 126/214 R
2,925,081 A * 2/1960 Shooter ..... 126/190

(Continued)

FOREIGN PATENT DOCUMENTS

DE 1 274 306 8/1968

(Continued)

*Primary Examiner*—Carl D. Price
(74) *Attorney, Agent, or Firm*—Russell W. Wamock; Craig J. Loest

(57) ABSTRACT

An apparatus includes a door, in particular, a cooking appliance door, through which a useful space can be closed, and having a stowage space, into which the door can be lowered at least partly, guided by a guide system that has a pivot axis and at least one guide element guided in a guide track, through which the door is guided in its movement along the guide track during a pivoting movement. The position of the pivot axis is fixed in the housing.

19 Claims, 4 Drawing Sheets

U.S. PATENT DOCUMENTS 2,936,206 A * 5/1960 Wilmer et al. ..... 312/322
3,113,338 A * 12/1963 Westiund ..... 49/250
3,127,889 A * 4/1964 Mills ..... 126/194
3,794,401 A * 2/1974 Dean et al. ..... 312/323
3,838,538 A * 10/1974 Burford ..... 49/258
4,600,254 A * 7/1986 Whalen ..... 312/323
4,726,352 A * 2/1988 Radke ..... 126/190
4,995,143 A * 2/1991 Demura et al. ..... 16/357
5,050,944 A * 9/1991 Fricano ..... 312/323
5,520,451 A * 5/1996 Oshima ..... 312/322

FOREIGN PATENT DOCUMENTS

| | | | |
|---|---|---|---|
| DE | 199 06 913 | | 8/2000 |
| DE | 199 06 913 | A1 | 8/2000 |
| FR | 2 269 888 | | 12/1975 |
| GB | 765006 | | 1/1957 |
| GB | 1072562 | | 6/1967 |
| JP | 59-161619 | * | 9/1984 |

* cited by examiner

APPARATUS WITH A DOOR, IN PARTICULAR, A COOKING APPLIANCE DOOR

CROSS-REFERENCE TO RELATED APPLICATION

This application is a continuation of copending International Application No. PCT/EP02/00647, filed Jan. 23, 2002, which designated the United States and was not published in English.

BACKGROUND OF THE INVENTION

FIELD OF THE INVENTION

The invention is based on an apparatus with a door, in particular, a cooking appliance door, through which a useful space can be closed, and having a stowage space, into which the door can be lowered at least partly.

German Published, Non-Prosecuted Patent Application DE 199 06 913 A1 discloses a generic apparatus of an oven with an oven door. The oven door can close a cooking chamber. Disposed underneath the cooking chamber is a stowage space, into which the oven door can be lowered, guided by a guide system.

In one configuration, guide tracks are disposed on both sides of the oven door, in which spindle-like, flexible pulling measures with a sliding block are guided, to which the oven door is fixed by a drive pin in each case such that it can move and rotate. The drive pins form a pivot axis of the oven door, which is displaced along the guide tracks when the oven door is opened. In addition to the drive pins, guide pins are fixed to the oven door, through which the oven door is guided in its movement in a further two guide tracks disposed at the side of the oven door.

SUMMARY OF THE INVENTION

It is accordingly an object of the invention to provide an apparatus with a door, in particular, a cooking appliance door that overcomes the hereinafore-mentioned disadvantages of the heretofore-known devices of this general type and that improves the door's operating convenience and the expenditure on its construction.

With the foregoing and other objects in view, there is provided, in accordance with the invention, an apparatus, including a housing defining a useful space and a stowage space, a pivotable door closing off the useful space when the door is in a closed position and disposed at least partly in the stowage space when the door is in an at least partly opened position, and a guide system guiding the door in a pivoting motion between the closed position and the open position, the guide system having a pivot axis being disposed at a fixed position in the housing, a guide track, and at least one guide element guided in the guide track, the guide system guiding the door along the guide track during a pivoting movement of the door.

The invention is based on an apparatus with a door, in particular, on a cooking appliance door, through which a useful space can be closed, and having a stowage space into which the door can be lowered at least partly, guided by a guide system that has a pivot axis and at least one guide element guided in a guide track, through which the door is guided in its movement along the guide track during a pivoting movement.

It is proposed that the position of the pivot axis be fixed in the housing. Using a particularly simple and cost-effective construction, a movement of the door in and out of the stowage space that is ergonomically beneficial to an operator can be achieved by, in particular, disposing the pivot axis in front of the stowage space and disposing the guide element after the pivot axis in the direction of an end of the door that pivots in the direction of the stowage space when the door is opened, and, advantageously, by guiding the door in its movement with at least one guide track fixed to it on a unit that forms the pivot axis, the guide element being disposed on the door and the guide track of the guide element being configured to be fixed to the housing. A pivot axis that is moved and guide tracks that are moved, and expenditure on construction necessitated thereby, can be avoided.

If a course of the guide track of the guide element always has at least one horizontal component, transitions between assembled guide track elements and/or complicated guide track curves can be avoided. The guide track can be configured cost-effectively, rectilinearly, and in one piece.

The stowage space for the door can be disposed at the side, above, or, advantageously, beneath the useful space, for example, a cooking chamber. In particular, in the case of a stowage space underneath the useful space, it is possible for a movement of the door that is ergonomically beneficial to a user and harmonious to be achieved by the configuration according to the invention. Furthermore, the door can, advantageously, be guided in its movement such that it can be used as a shelf and/or as a drip guard.

If, during a movement of the door into the stowage space, the guide element is guided in the direction of the useful space through the guide track, and, to be specific, particularly advantageously at an angle between 5° and 15°, it is possible to achieve the situation where, at the start of opening the door, a direction of movement of the guide element, produced by a pivoting movement about the pivot axis, substantially coincides with an alignment of the guide track of the guide element. This means that a harmonious movement of the door can be achieved and canting of the door can be avoided. If, furthermore, the stowage space for the door is disposed underneath the useful space so that the guide track of the guide element runs obliquely vertically upward in the direction of the useful space, as viewed in the direction of movement of the guide element as the door is opened, the guide track can be used to produce a horizontal force component on the door in the direction of the useful space by using the force due to the weight of the door. Advantageous sealing of the useful space can be achieved without additional elements that load the door in the closing direction. Furthermore, an advantageous second useful space can be achieved underneath the stowage space for the door, in which, for example, baking sheets or other accessories can be kept.

If the guide element is disposed at one end of the door and pivots in the direction of the stowage space when the door is opened, overall space can be saved and the door can be guided into the stowage space directly at the end of the door. However, it is also possible to fit the guide element at a certain distance in front of the end of the door.

If the door can be held by at least one holding mechanism in at least one position, such as, in particular, in its closed position, an undesired movement of the door, for example, an opening movement in the closed state, can safely be prevented. A child safeguard can, additionally, be integrated simply into the holding mechanism. In addition to a closed position, the door can be held by a holding mechanism in further positions that appear expedient to those skilled in the art, such as in a position in which the door can, advantageously, be used as a shelf and/or as a drip guard, and so on. Furthermore, specific positions of the door can be signaled to an operator by the holding mechanism. As a result, the operator can move the door quickly and safely into a desired position.

In accordance with another feature of the invention, the guide track of the guide element runs rectilinearly.

In accordance with a further feature of the invention, the guide track has a course with at least one horizontal component throughout the course.

In accordance with an added feature of the invention, the guide track runs rectilinearly.

In accordance with an additional feature of the invention, the stowage space is disposed underneath the useful space.

In accordance with yet another feature of the invention, the guide track guides the guide element in a direction of the useful space during movement of the door into the stowage space.

In accordance with yet a further feature of the invention, the door has an end pivoting in a direction of the stowage space as the door is opened and the guide element is disposed at the end of the door.

In accordance with yet an added feature of the invention, there is provided at least one holding mechanism holding or retaining the door in at least one position. The holding mechanism can be formed by various apparatuses that appear expedient to those skilled in the art, but, particularly advantageously, by a latching mechanism, with which a holding mechanism convenient for an operator can be implemented in a constructionally simple manner. The latching mechanism can include elastically deformable latching elements or, preferably, one or more spring-loaded rockers, through which the door can, advantageously, be loaded into its closed position when in the closed state.

If the pivot axis is formed by at least two rolling elements and/or the guide element is formed by a rolling element rotatably mounted on the door, friction and wear can be reduced and the requisite operating forces can be lowered.

In accordance with yet an additional feature of the invention, there are provided at least two rolling elements forming the pivot axis.

In accordance with again another feature of the invention, the rolling element is mounted on a lower end section of the door.

In accordance with a concomitant feature of the invention, the apparatus is an appliance and the door is an appliance door.

Other features that are considered as characteristic for the invention are set forth in the appended claims.

Although the invention is illustrated and described herein as embodied in an apparatus with a door, in particular, a cooking appliance door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
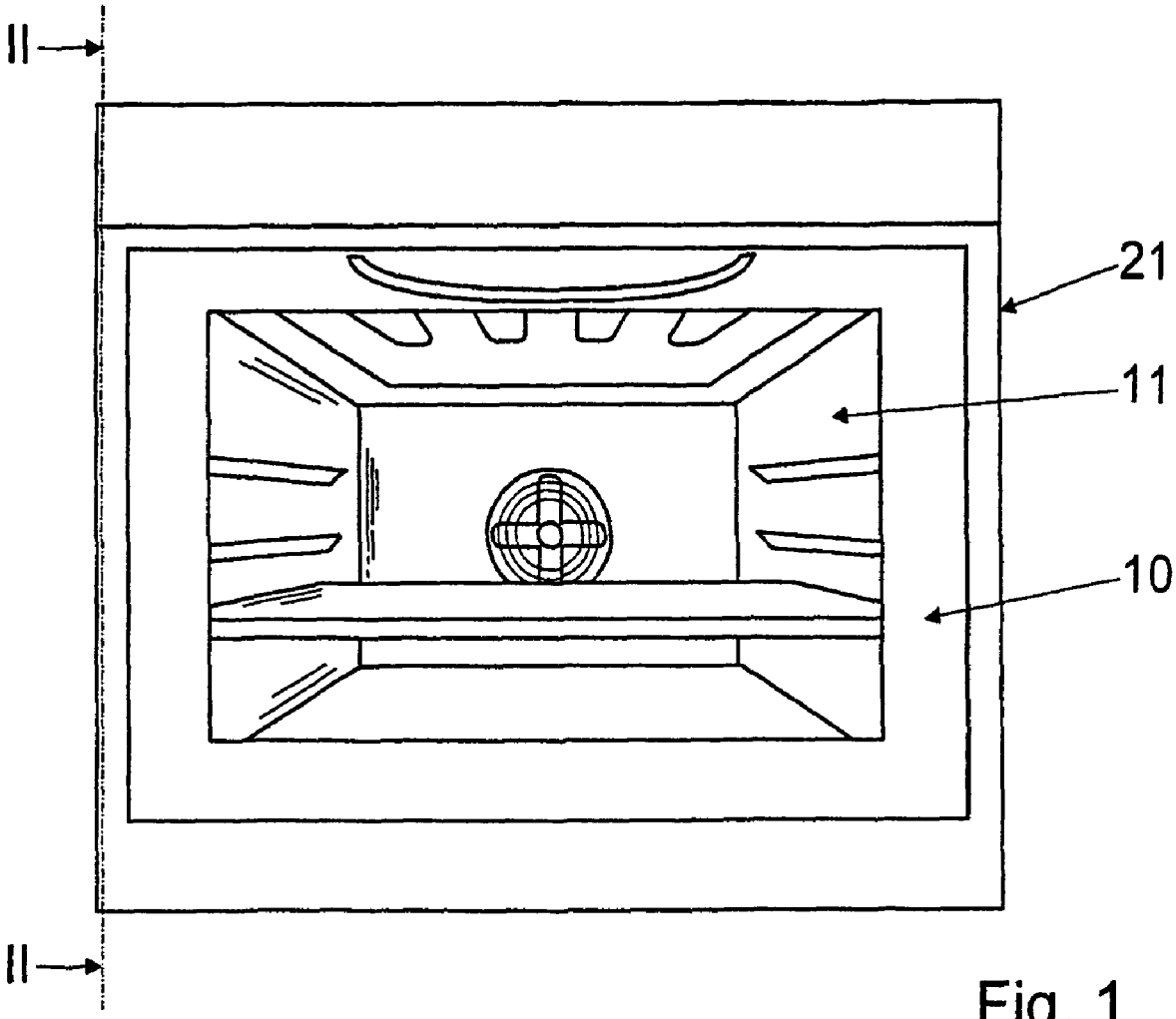
FIG. 1 is a perspective view of a household oven according to the invention from the front.
Figure 2:
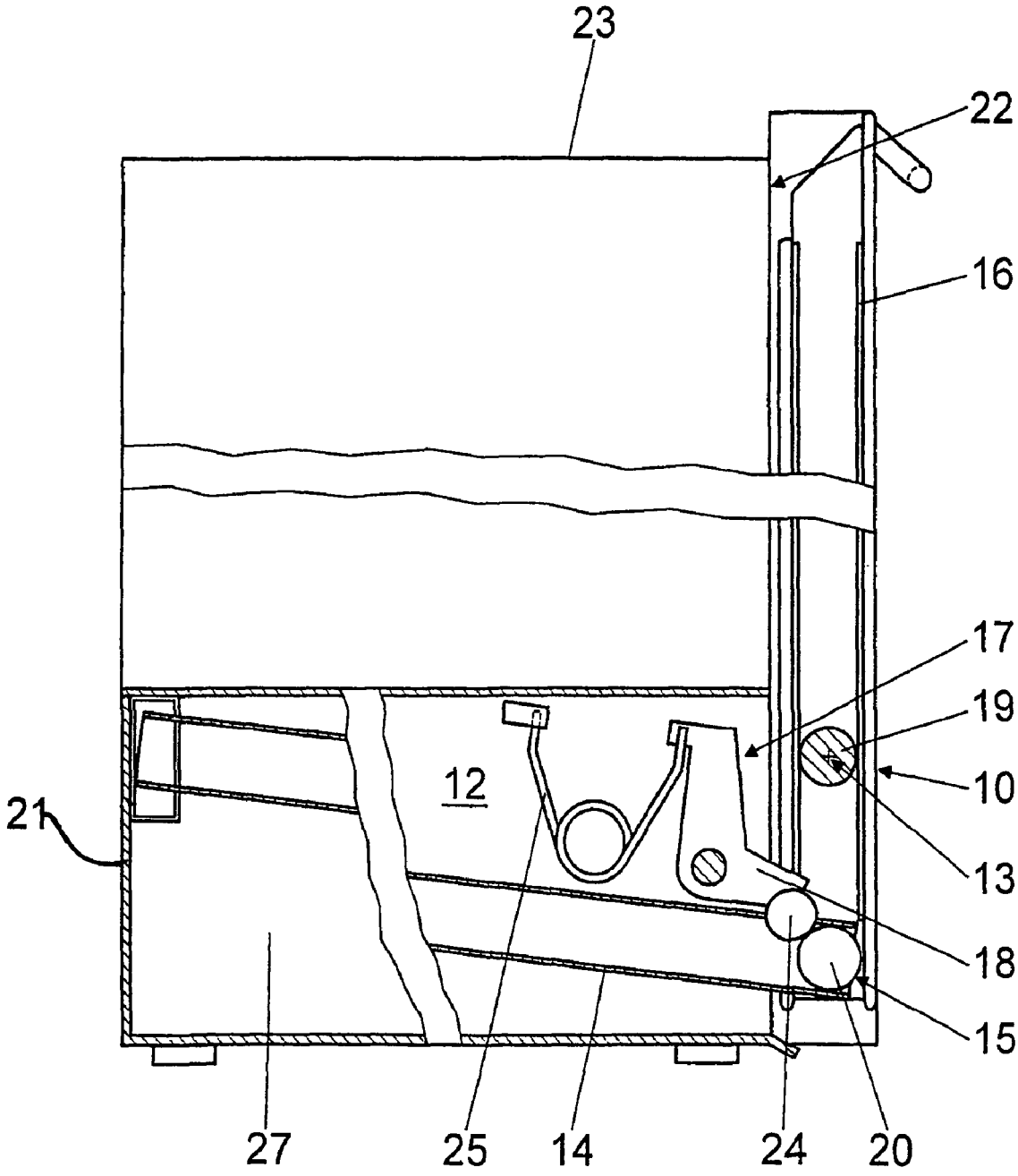
FIG. 2 is a fragmentary, cross-sectional view of the oven of FIG. 1 along section line II-II in FIG. 1 with the oven door closed.

Referring now to the figures of the drawings in detail and first, particularly to FIG. 1 thereof, there is shown a household oven, which has a cooking chamber 11 in a housing 21. The cooking chamber 11 is bounded by a muffle 23 and has an opening 22 that is closed by an oven door 10 (FIG. 2). Disposed in the housing 21, under the cooking chamber 11, is a stowage space 12, into which the oven door 10 can be lowered, guided by a guide system.

The guide system has, according to the invention, a pivot axis 13 of which the position is fixed in the housing 21 and which is formed by two rollers 19 rotatably mounted and fixed to the housing 21 at the sides of the oven door 10. The pivot axis 13 is disposed in front of the stowage space 12. In each case, a guide track 16 formed by a U-section is fixed to the sides of the oven door 10, through which track 16 the oven door 10 is guided in its movement on the rollers 19.

Furthermore, at the lower end of the oven door 10, which pivots in the direction of the stowage space 12 as the oven door 10 is opened (FIGS. 3 and 4), guide elements 15 are fixed at the sides, being formed by rotatably mounted rollers 20 that extend laterally. The oven door 10 is guided in its movement by the guide elements 15 in two guide tracks 14 fixed to the housing 21 beside the oven door 10 and formed by U-sections. The guide tracks 14 extend laterally from the stowage space 12, rectilinearly obliquely vertically upward from a front region of the household oven in the direction of the cooking chamber 11 into a rear region of the household oven.

As a result of the guide tracks 14 extending obliquely vertically upward in the direction of the cooking chamber 11, a horizontal force component is produced on the oven door 10 in the direction of the cooking chamber 11 by the force due to the weight of the oven door 10 in its closed position, and, advantageously, seals off the cooking chamber 11.

Furthermore, the oven door 10 is held in its closed position by a holding mechanism 17 formed by a latching mechanism. In each case, laterally beside the oven door 10, the holding mechanism 17 has a spring-loaded rocker 18 that respectively projects with an integrally molded pin 24 through recesses into the guide tracks 14 and secures the guide elements 15 in their positions. When the oven door 10 is opened, the pins 24 are forced out of the guide tracks 14 in the direction of the cooking chamber 11 by the guide elements 15 and, in the process, the rockers 18 are deflected outward, counter to a spring force from a two-leg spring 25 in each case. As soon as the guide elements 15 have crossed over the pins 24, the rockers 18 are set back into their initial position by the two-leg springs 25.

When the oven door 10 is opened (see FIGS. 3 and 4), it is pivoted about the pivot axis 13 and, in the process, guided by the guide elements 15 along the guide tracks 14 and over the guide tracks 16 onto the rollers 19 forming the pivot axis 13.

Figure 3:
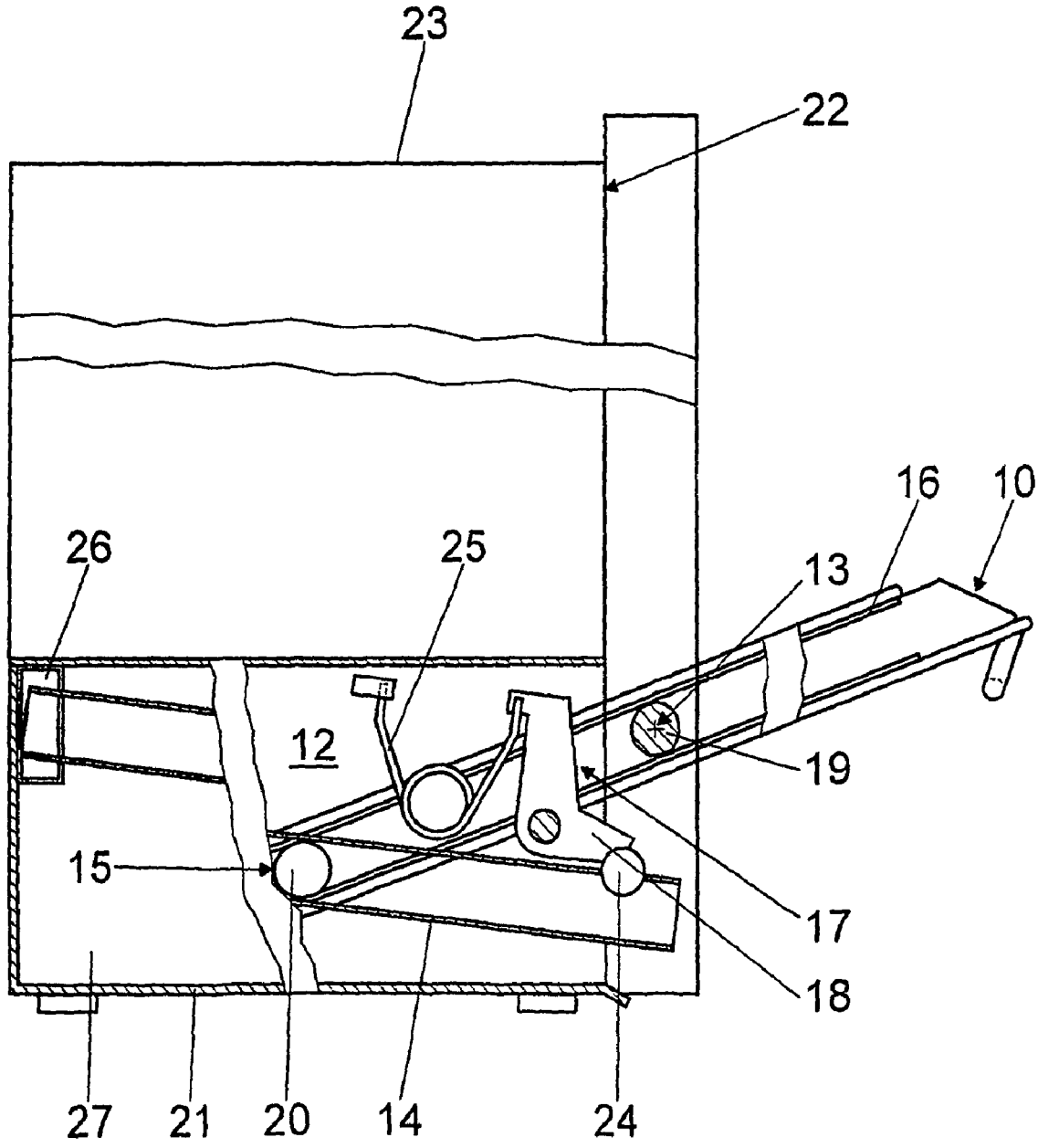
FIG. 3 is a fragmentary, cross-sectional view of the oven of FIG. 2 with the oven door partly lowered.
Figure 4:
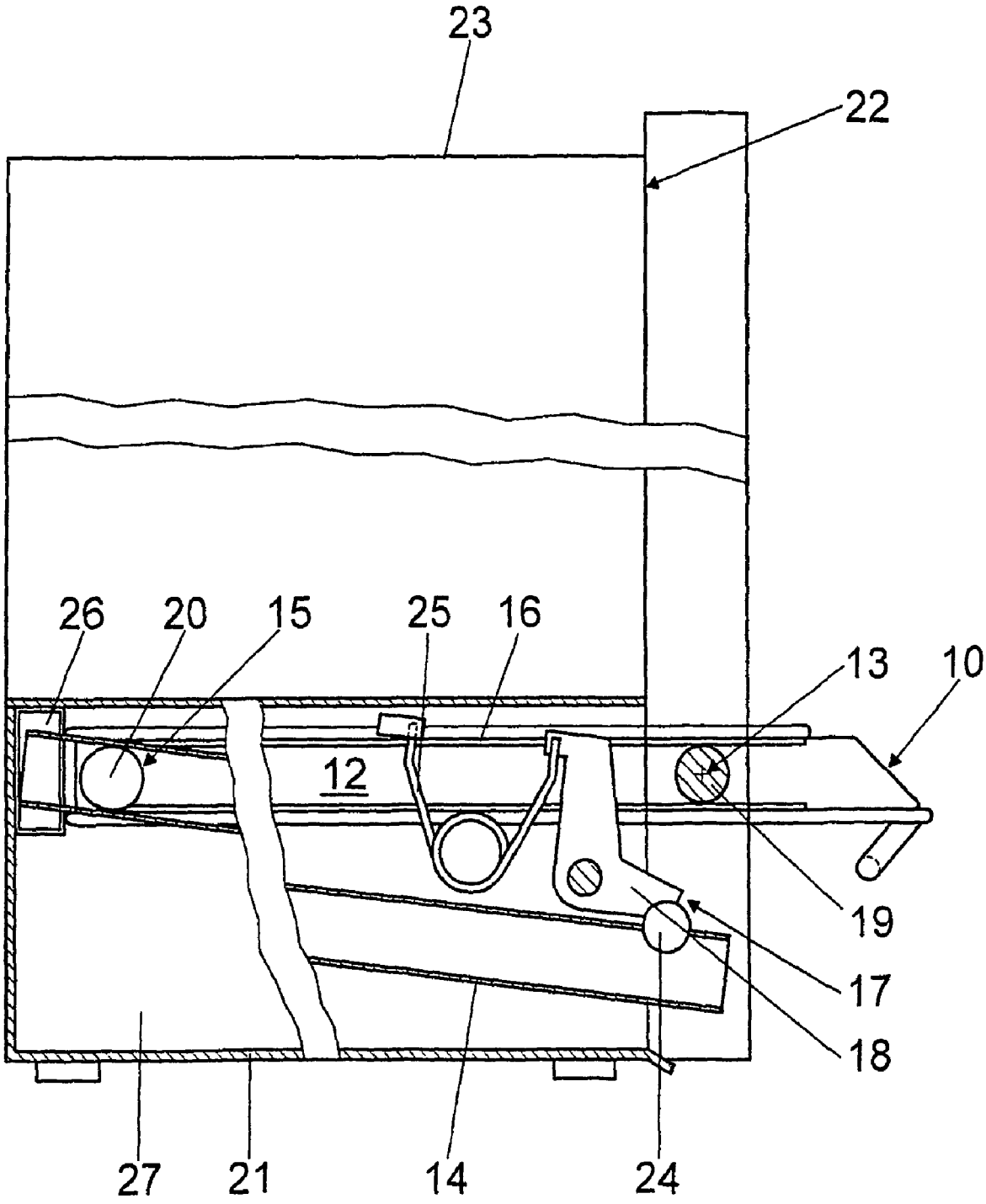
FIG. 4 is a fragmentary, cross-sectional view of the oven of FIG. 2 with the oven door lowered completely.

FIG. 3 shows the oven door in a partly lowered position, in which it can be used as a shelf and as a drip guard. FIG.

4 shows the oven door 10 in the completely lowered state, resting with its end pointing into the stowage space on a stop 26. The pivot axis 13 is disposed at a short distance underneath the cooking chamber 11 and lies in a horizontal plane with the guide elements 15. The oven door 10 runs at a short distance of between about 2 and 5 cm parallel to a base of the cooking chamber. Underneath the stowage space 12 for the oven door 10, there is a useful space 27 in which, for example, baking sheets can be kept. To increase the convenience, the oven door can, also, optionally be configured with a drive, for example, with an electric motor and a lifting mechanism, and so on.

We claim:

1. An apparatus, comprising:

a housing defining a useful space and a stowage space, the housing having a front region and a rear region and the useful space being accessible via an opening in the front region of the housing;

a pivotable door for closing off said useful space when said door is in a closed position and disposed at least partly in said stowage space when said door is in an at least partly opened position; and a guide system for guiding said door in a pivoting motion between said closed position and said open position, said guide system having:

a pivot axis being defined at a fixed position in said housing for pivoting movement of said door thereabout;

at least one first guide track attached to said door;

at least one first guide element attached to said housing to define said pivot axis and disposed within said at least one first guide track, said guide system guiding said door and said at least one first guide track along said at least one first guide element during a pivoting movement of said door about said pivot axis and said at least one first guide element;

at least one second guide track fixed to said housing within said stowage space and extending vertically obliquely upwardly from one end thereof toward an opposite end thereof in a direction from the front region of the housing toward the rear region of the housing;

at least one second guide element fixed to said door and guided for movement along said at least one second guide track, said at least one second guide element being spatially separated from said pivot axis and movable relative to said pivot axis; and whereby said guide system guides said at least one second guide element along said at least one second guide track during said pivoting movement of said door thereby moving said door into said stowage space, said second guide element being located toward the one end of said at least one second guide track when the door is in its closed position and said guide system guiding said second guide element along said at least one second guide track from the one end of said at least one second guide track toward its opposite end during movement of the door between its closed position and its at least partly opened position, whereby said second guide element moves vertically obliquely upwardly along said at least one second guide track against the force of gravity.

2. The apparatus according to claim 1, wherein:

said door has an end pivoting in a direction of said stowage space when said door is opened;

said pivot axis traverses a front of said stowage space; and said at least one second guide element is disposed away from said pivot axis in a direction of said end.

3. The apparatus according to claim 2, wherein said at least one second guide track is fixed in said housing.

4. The apparatus according to claim 1, wherein:

said at least one second guide track has a course; and said course always has at least one linear component.

5. The apparatus according to claim 4, wherein said at least one second guide track extends rectilinearly.

6. The apparatus according to claim 1, wherein said at least one first guide track has a course with at least one linear component throughout said course.

7. The apparatus according to claim 4, wherein said at least one first guide track extends rectilinearly.

8. The apparatus according to claim 1, wherein said stowage space is disposed underneath said useful space.

9. The apparatus according to claim 1, wherein said at least one second guide track guides said at least one second guide element in a direction of said useful space during movement of said door into said stowage space.

10. The apparatus according to claim 1, wherein:

said door has an end pivoting in a direction of said stowage space as said door is opened; and said at least one second guide element is disposed at said end of said door.

11. The apparatus according to claim 1, further comprising at least one holding mechanism holding said door in at least one position.

12. The apparatus according to claim 11, wherein said holding mechanism is a latching mechanism.

13. The apparatus according to claim 11, wherein said holding mechanism has a spring-loaded rocker.

14. The apparatus according to claim 1, further comprising at least one holding mechanism retaining said door in at least one position.

15. The apparatus according to claim 1, wherein said pivot axis is at least two rolling elements.

16. The apparatus according to claim 1, further comprising at least two rolling elements forming said pivot axis.

17. The apparatus according to claim 1, wherein said at least one second guide element is a rolling element rotatably mounted on said door on a selected one of a lower end section of said door and another section of said door.

18. The apparatus according to claim 1, wherein the apparatus is an appliance and said door is an appliance door.

19. An oven, comprising:

an oven housing defining a cooking space and a stowage space, the oven housing having a front region and a rear region and the cooking space being accessible via an opening in the front region of the oven housing;

a pivotable door for closing off said cooking space when said door is in a closed position and disposed at least partly in said stowage space when said door is in an at least partly opened position; and a guide system for guiding said door in a pivoting motion between said closed position and said open position, said guide system having:

a pivot axis being defined at a fixed position in said housing for pivoting movement of said door thereabout;

at least one first guide track attached to said door;

at least one first guide element attached to said housing to define said pivot axis and disposed within said at least one first guide track, said guide system guiding said door and said at least one first guide track along said at least one first guide element during a pivoting movement of said door about said pivot axis and said at least one first guide element;

at least one second guide track fixed to said housing within said stowage space;

at least one second guide element fixed to said door and guided for movement along said at least one second guide track, said at least one second guide element being spatially separated from said pivot axis and movable relative to said pivot axis and extending vertically obliquely upwardly from one end thereof toward an opposite end thereof in a direction from the front region of the oven housing toward the rear region of the oven housing; and whereby said guide system guides said at least one second guide element along said at least one second guide track during said pivoting movement of said door, said second guide element being located toward the one end of said at least one second guide track when the door is in its closed position and said guide system guiding said second guide element along said at least one second guide track from the one end of said at least one second guide track toward its opposite end during movement of the door between its closed position and its at least partly opened position, whereby said second guide element moves vertically obliquely upwardly along said at least one second guide track against the force of gravity.

* * * * *